US006162597A

United States Patent [19]

Bauer et al.

[11] Patent Number: 6,162,597

[45] Date of Patent: Dec. 19, 2000

[54] IMAGING ELEMENTS ADHESION PROMOTING SUBBING LAYER FOR PHOTOTHERMOGRAPHIC IMAGING LAYERS

[75] Inventors: Charles L. Bauer, Webster; Cathy A. Fleischer, Rochester, both of N.Y.

[73] Assignee: Eastman Kodak Company, Rochester, N.Y.

[21] Appl. No.: 09/466,453

[22] Filed: Dec. 17, 1999

[51] Int. Cl.[7] ..... G03C 1/498; G03C 1/76

[52] U.S. Cl. ..... 430/535; 430/531; 430/533; 430/617; 430/619; 430/631

[58] Field of Search ..... 430/619, 617, 430/523, 531, 533, 631, 535

[56] References Cited

U.S. PATENT DOCUMENTS

| | | |
|---|---|---|
| 3,501,301 | 3/1970 | Nadeau et al. . |
| 3,645,740 | 2/1972 | Nishio et al. . |
| 4,098,952 | 7/1978 | Kelly et al. . |
| 4,128,426 | 12/1978 | Ohta et al. . |
| 4,328,283 | 5/1982 | Nakadate et al. . |
| 4,609,617 | 9/1986 | Yamazaki et al. . |
| 5,618,657 | 4/1997 | Rieger et al. . |
| 5,677,116 | 10/1997 | Zengerle et al. . |
| 5,718,981 | 2/1998 | Fleischer et al. . |
| 5,968,646 | 10/1999 | Grace et al. . |

FOREIGN PATENT DOCUMENTS

| | | |
|---|---|---|
| 0 035 614 | 9/1981 | European Pat. Off. . |
| 2 037 792 | 7/1980 | United Kingdom . |
| 2 046 626 | 11/1980 | United Kingdom . |
| 1 583 343 | 1/1981 | United Kingdom . |

OTHER PUBLICATIONS

Research Disclosure, Item No. 18358, Jul. 1979.
Japanese Patent Abstract 5134356 A.
Japanese Patent Abstract 59094756 A.

*Primary Examiner*—Thorl Chea
*Attorney, Agent, or Firm*—Chris P. Konkol

[57] ABSTRACT

A polyester support having an adjacent subbing layer which comprises a polymer or copolymer of glycidyl acrylate and/or glycidyl methacrylate improves the adhesion of a photothermographic imaging layer containing a poly(vinyl butyral) binder coated from an organic solvent. The subbing layer can be applied in the form of an aqueous dispersion in the prescence of a coalescing agent. Such a subbing layer does not adversely affect sensitometry in a photothermographic or thermographic element.

25 Claims, No Drawings

IMAGING ELEMENTS ADHESION PROMOTING SUBBING LAYER FOR PHOTOTHERMOGRAPHIC IMAGING LAYERS

FIELD OF THE INVENTION

The present invention relates to an undercoat or primer layer on a polyester support to improve its adhesion to a photothermographic imaging layer containing a poly(vinyl acetal) material. In particular, it has been found that a poly(glycidyl methacrylate) undercoat improves the adhesion without adversely impacting sensitometry.

BACKGROUND OF THE INVENTION

Thermally processable imaging elements, including films and papers, are well known. These elements include photothermographic elements in which an image is formed by imagewise exposure of the element to light followed by development involving uniformly heating the element. These elements also include thermographic elements in which an image is formed by imagewise heating the element. Such elements are described in, for example, Research Disclosure, June 1978, Item No. 17029 and U.S. Pat. Nos. 3,080,254, 3,457,075 and 3,933,508.

Polyester materials are widely used as a support or base for such photothermographic or thermographic materials, on account of their excellent physical properties for that purpose.

If the adhesion between the photothermographic layer and the support is insufficient, several practical problems arise. If the photographic material is brought into contact with a sticky material, such as splicing tape, the photographic layers may be peeled from the support resulting in a loss of image-forming capability. In the manufacturing process, a photographic subjected to slitting or cutting operations and in many cases perforated holes are punched into the material for film advancement in cameras and processors. Poor adhesion can result in a delamination of the photographic layers from the support at the cut edges of the photographic material which can generate many small fragments of chipped-off emulsion layers which then cause spot defects in the imaging areas of the photographic material. If there is poor adhesion between the emulsion and base, delamination of the emulsion from the base may occur during thermal development of the photographic material in the processors. The photographic material may undergo spot delamination or blistering due to processing at elevated temperatures or may be damaged by transport rollers during processing or subsequent thereto.

Another variation on this problem is "blocking," which occurs during the manufacturing of a photographic element when a continuous web coated with a subbing layer is wound in roll form before application of the emulsion layers. In this instance, the front-side containing the subbing layer is brought into intimate contact with the backside layers, which then can stick or block together. This prevents or makes more difficult the unwinding of the roll for subsequent coatings and can also cause static build-up in the roll, leading to charging or marking of the emulsion layer.

In traditional (non-photothermographic) systems, various subbing processes and materials have, therefore, been used or proposed in order to produce improved adhesion between the support film and the hydrophilic colloid layer in traditional silver-halide photographic systems. Polymers known and used in what is referred to as a subbing layer for promoting adhesion between a support and an emulsion layer are disclosed in U.S. Pat. Nos. 2,627,088; 2,968,241; 2,764,520; 2,864,755; 2,864,756; 2,972,534; 3,057,792; 3,071,466; 3,072,483; 3,143,421; 3,145,105; 3,145,242; 3,360,448; 3,376,208; 3,462,335; 3,475,193; 3,501,301; 3,944,699; 4,087,574; 4,098,952; 4,363,872; 4,394,442; 4,689,359; 4,857,396; British Patent Nos. 788,365; 804,005; 891,469; and European Patent No. 035,614. Often used are polymers of monomers having polar groups in the molecule such as carboxyl, carbonyl, hydroxy, sulfo, amino, amido, glycidyl or acid anhydride groups, for example, acrylic acid, sodium acrylate, methacrylic acid, itaconic acid, crotonic acid, sorbic acid, itaconic anhydride, maleic anhydride, cinnamic acid, methyl vinyl ketone, hydroxyethyl acrylate, hydroxyethyl methacrylate, hydroxychloropropyl methacrylate, hydroxybutyl acrylate, vinylsulfonic acid, potassium vinylbenezensulfonate, acrylamide, N-methylamide, N-methylacrylamide, acryloylmorpholine, dimethylmethacrylamide, N-t-butylacrylamide, diacetonacrylamide, vinylpyrrolidone, glycidyl acrylate, glycidyl methacrylate, or copolymers of the above monomers with other copolymerizable monomers.

Additional examples are polymers of ethylenically unsaturated esters or ethylenically unsaturated acids represented by, for example, acrylic acid esters such as ethyl acrylate or butyl acrylate, methacrylic acid esters such as methyl methacrylate or ethyl methacrylate, or copolymers of these monomers with other vinylic monomers; or copolymers of polycarboxylic acids such as itaconic acid, itaconic anhydride, maleic acid or maleic anhydride with vinylic monomers such as styrene, vinyl chloride, vinylidene chloride or butadiene, or trimers of these monomers with other ethylenically unsaturated monomers.

Traditionally, one commonly practiced process for providing good adhesion of photographic emulsions to polyester supports involves applying an adhesion promoting layer or subbing layer to the polyester followed by a coating of gelatin. Materials in the adhesion promoting layer generally comprise a copolymer containing a chloride group such as vinylidene chloride.

Although apparently experiencing little commercial use, glycidyl-containing polymers have been proposed for improving the adhesion of a traditional light-sensitive emulsion to a polyester support. For example, U.S. Pat. No. 4,328,283 to Nakadata et al. discloses a polyester support on the surface thereof with a subbing layer formed by coating the support surface with an aqueous composition containing a copolymer consisting of the following components: (1) 30–70 wt % glycidyl acrylate and/or glycidyl methacrylate monomer, (2) 3–45 wt % hydroxyalkyl acrylate having an alkyl group of 2 to 4 carbon atoms and/or hydroxyalkyl methacrylate monomer, and (3) 0–67 wt % copolymerizable vinyl monomer. It was found that wet-film adhesion force was low in the case when less than 30 wt % of the first component was present, and dry-film adhesion force deteriorated when more than 70 wt % was present.

U.S. Pat. No. 3,645,740 to Nishio describes photographic elements that use a blend of gelatin with either a glycidyl methacrylate or glycidyl acrylate homopolymer or copolymer as subbing layers for PET (polyethylene terephthalate) supports. Besides providing adhesion, the coating solutions were found to have good stability, and wound coated rolls did not block.

U.S. Pat. No. 4,098,952 to Kelly et al describes a primer for PET supports that contains a copolymer comprising 3–25 mole % glycidyl (meth)acrylate. U.S. Pat. No. 4,128,426 to Ohta et al describes a subbing layer for photographic film which comprises a copolymer containing 20 to 90% glycidyl (meth)acrylate. U.S. Pat. No. 4,609,617 to Yamazaki et al describes a subbing layer for photographic film comprising a copolymer containing 0.01 % to 70% glycidyl (meth) acrylate. GB 1583343 to Mann describes a subbing layer for photographic elements that contains copolymers of acrylic acid or methacrylic acid and their derivatives such as glycidyl (meth)acrylate. GB 2037792 to Kitihara et al describes subbing layers for photographic polyester supports that use copolymers containing 35–55 wt % glycidyl (meth) acrylate. The subbing layer is applied during the manufacturing of the PET. The applied subbing layer is then subjected to corona discharge treatment before applying additional layers. Other patent publications which disclose, in general, the use of a copolymer containing glycidyl methacrylate as a subbing layer for photographic use include JP 5134356, JP 59094756, and EP 35614. A research disclosure, RD 18358 1979, describes the use of a butyl acrylate-glycidyl methacrylate-styrene (40-40-20) copolymer as a subbing layer for photography. Notwithstanding the above disclosures, subbing layers comprising polymers of glycidyl acrylic or glycidyl methacrylate, and particularly homopolymers of these monomer, have not experienced widespread commercial application, suggesting that such proposed subbing materials and processes are either not economical, difficult to manufacture, and/or do not provide the desired performance characteristics for commercial application.

The latter glycidyl-containing polymers have been disclosed for use in traditional photography. More commonly, however, traditional methods to improve adhesion of the emulsion have included vinylidene-chloride-containing copolymers as subbing layers and surface treatment. For photothermographic systems, however, these approaches have been found to alter the emulsion sensitometry/keeping, cause blocking of support rolls (before emulsion coating), or provide inadequate adhesion.

Thermally processable imaging elements which include a thermographic or photothermographic layer, a protective overcoat layer and an adhesive interlayer, comprising a glycidyl-containing polymer, interposed between the overcoat layer and the thermographic or photothermographic layer are disclosed and claimed in U.S. Pat. No. 5,422,234. This patent discloses a polymer having glycidyl-functionality which polymer has been found to serve as an effective adhesion-promoting layer that overcomes the difficult problem of providing good adhesion between an overcoat that is typically hydrophilic and an imaging layer that is typically hydrophobic. Moreover, use of a polymer having glycidyl functionality for this purpose not only provides effective overcoat/imaging layer adhesion, but causes no adverse sensitometric effects and involves the use of low cost, readily available materials which are easily handled and coated and are environmentally advantageous.

None of the above prior art discloses the use of glycidyl-functional polymeric layer between a polyester support and a poly(vinyl acetal)-containing phothermographic or thermographic imaging layer to promote adhesion. In this case, the imaging layer is applied, not in an aqueous system, but in an organic solvent.

It is accordingly a primary object of the present invention to provide subbed polyester supports for excellent film adhesion to a poly(vinyl acetal)-containing layer.

SUMMARY OF THE INVENTION

The present invention is directed to thermally processable imaging elements that include a polyester support or base, a thermographic or photothermographic layer, and an adhesive interlayer comprising a glycidyl-containing polymer interposed between the support and the thermographic or photothermographic layer. The use of a polymer having glycidyl functionality for this purpose has been found to provide effective adhesion and to cause no adverse sensitometric effects. In accordance with the present invention, a glycidyl-functional polymer is used as an in-line undercoat on a polyester support such as polyethylene terephthalate to improve the adhesion of a photothermographic or thermographic imaging element containing poly(vinyl acetal) as the binder, which binder is coated from an organic solvent. In accordance with this invention, a thermally processable imaging element is comprised of:

(1) a polyester support;

(2) a thermographic or photothermographic imaging layer comprising a poly(vinyl acetal) polymer; and (4) an adhesive interlayer bonding the imaging layer to the support, the adhesive interlayer comprising a polymer having glycidyl functionality, wherein the mole percent of glycidyl-functional monomeric or recurring units is greater than 75 percent.

The invention is also directed to a process for preparing a photothermographic or thermographic element, comprising in-line coating of a polyester web with a glycidyl-containing polymer, followed by the coating with a composition comprising poly(vinyl acetal) binder from an organic solvent.

The thermally processable imaging element of this invention can be a black-and-white imaging element or a dye-forming imaging element. It can be of widely varying construction as long as it includes the aforesaid support, imaging layer, and adhesive interlayer.

Typical imaging elements within the scope of this invention comprise at least one imaging layer containing, in addition to a poly(vinyl acetal) binder, a photographic silver halide in reactive association with an organic silver salt as an oxidizing agent, preferably a silver salt of a long chain fatty acid such as silver behenate. The imaging element typically further comprises a reducing agent for the organic-silver-salt oxidizing agent. References describing such imaging elements include, for example, U.S. Pat. Nos. 3,457,075; 4,459,350; 4,264,725 and 4,741,992 and Research Disclosure, June 1978, Item No. 17029.

DETAILED DESCRIPTION OF THE INVENTION

The above-mentioned objects can be accomplished by applying in-line to a thermally processable element a coating of a subbing layer comprising a copolymer or homopolymer of glycidyl methacrylate (hereinafter referred to as GMA), glycidyl acrylate (hereinafter referred to as GA), or a copolymer of a vinyl monomer with GMA and/or GA.

It has been found that a polymer having greater than 75 mole percent glycidyl-functional monomeric units, preferably greater than 80 mole percent, more preferably greater than 90 mole percent, most preferably about 100 percent glycidyl-functional monomeric or recurring units provides the desired adhesion.

By the term "glycidyl functionality" is meant a group comprising an oxirane ring attached to an alkyl group having one to four carbon atoms, preferably a methyl group.

Optional comonomers to be copolymerized with GMA or GA are monomers that will substantially copolymerize with GMA or GA, which will not react with the glycidyl group during emulsion polymerization and which will effect emulsion polymerization. Suitable vinyl comonomers are, for example, alkyl acrylates, said alkyl group having from one to four carbon atoms; alkyl methacrylates, said alkyl group having from one to four carbon atoms; other substituted alkyl acrylates; acrylamide derivatives; methacrylamide derivatives; vinyl halides such as vinyl chloride; vinylidene halides such as vinylidene chloride; vinylpyrrolidone; other N-vinylamides; vinylpyridines; styrene; styrene derivatives such as alpha-methyl styrene; butadiene; isoprene; acrylonitrile; methacrylonitrile, and the like. The copolymer may be a terpolymer containing two or more vinyl monomers. The proportion of GMA or GA in the copolymer of GMA or GA with the vinyl monomer is suitably greater than 75 mole percent or more, preferably greater than 90 mole percent, more preferably 100 mole percent (the homopolymer).

Preferably, the above-described polymers having glycidyl functionality are prepared by reacting a polymerizable glycidyl-functional monomer with one or more polymerizable acrylic monomers. Examples of suitable polymerizable acrylic monomers include ethyl acrylate, ethyl methacrylate, butyl acrylate, butyl methacrylate, cyclohexyl acrylate, cyclohexyl methacrylate, methyl acrylate, lauryl acrylate, lauryl methacrylate, allyl methacrylate, hydroxyethyl methacrylate, hydroxyethyl acrylate, and the like. Examples of suitable polymerizable glycidyl-functional monomers include glycidyl methacrylate, glycidyl acrylate, an allyl glycidyl ether.

Though the molecular weight of the polymer used in this invention cannot always be exactly determined because it has may have bridging structure by means of glycidyl groups, it is preferably above 10,000, more preferably more than 50,000.

As hereinabove described, the improved thermally processable imaging element of this invention includes an adhesive interlayer interposed between the imaging layer and the support, which comprises a glycidyl-functional polymer. The glycidyl-functional polymer (inclusive of copolymer and homopolymer) is preferably dispersed as finely divided particles in an aqueous-dispersion medium which is then used as a coating liquid for the formation of the subbing layer. A part of water may be replaced by a water-miscible organic solvent (e.g., methanol or acetone). The polymer of the present invention preferably is prepared by emulsion polymerization, that is, obtained as an aqueous dispersion of particulate emulsion polymerizate, a so-called latex. In general, preparation by emulsion polymerization of the glycidyl-containing polymer in an aqueous composition may be carried out by the following procedure. To an appropriate reaction vessel charged with deaerated distilled water are added monomers selected from the compounds hereinbefore mentioned, followed by addition thereto of suitable amounts of a surface active agent for emulsion polymerization and a water-soluble polymerization initiator, e.g., potassium persulfate or the like. Thereafter, the mixture thus charged is heated with stirring at 50 to 90° C. for several hours to undergo emulsion polymerization. Alternatively, a polymer-containing aqueous composition may also be obtained in the following manner where monomer components are dissolved in an appropriate solvent to prepare a solution, the resulting solution is charged with necessary amounts of a polymerization initiator and polymerization promoter, heated, and then allowed to stand for several hours. Subsequently, the reaction liquid thus obtained is vigorously mixed with an aqueous solvent and a surfactant as an emulsifier.

Aqueous compositions containing the present polymers are preferably used in such a manner that the polymer prepared as an aqueous dispersion according to the aforementioned alternate methods is diluted, if necessary, with water or a water-miscible organic solvent so that the solids concentration in the diluted dispersion of said polymer may become 0.1–10 wt %, though the mode of using the present composition may vary depending on the purpose for which said composition is used and on the coating technique employed therefor. The aqueous compositions may contain a variety of additives besides the above-mentioned polymer. For instance, the aqueous compositions may comprise, in order to improve dispersibility of polymer particles or coatability of the composition at the time of subbing treatment, with anionic surface active agents such as alkali metal or ammonium salts of alcohol sulfuric acid of 8 to 18 carbon atoms; ethanolamine lauryl sulfate; ethylaminolauryl sulfate; alkali metal and ammonium salts of paraffin oil; alkali metal salts of aromatic sulfonic acid such as dodecane-1-sulfonic acid, octadiene-1-sulfonic acid or the like; alkali metal salts such as sodium isopropylbenzenesulfate, sodium isobutylnaphthalenesulfate or the like; and alkali metal or ammonium salts of esters of sulfonated dicarboxylic acid such as sodium dioctylsulfosuccinate, disodium dioctadecylsulfosuccinate or the like; nonionic surface active agents such as saponin, sorbitan alkyl esters, polyethyle oxides, polyoxyethylene alkyl ethers or the like; cationic surface active agents such as octadecyl ammonium chloride, trimethyldosecyl ammonium chloride or the like; and high molecular surface active agents other than those above mentioned such as polyvinyl alcohol, partially saponified vinyl acetates, maleic acid containing copolymers, gelatin or the like. Further, additives which may be incorporated into the present aqueous composition include inorganic matting agents such as titanium oxide, silicon oxide, colloid silica, zinc oxide, aluminum oxide, etc., matting agents comprising particles of polymers such as polymethyl methacrylate, etc., antistatic agents comprising inorganic salts or copolymers and, according to the purpose for which the present aqueous composition is used, dyes or pigments for coloring purposes and alkali or acid for adjusting a pH value of the present polymer-containing composition. Furthermore, the present compositions may also comprise, according to the particular purpose for which they are used, hardeners which include aldehyde-containing compounds such as formaldehyde, glyoxal, and the like; ethyleneimino-containing compounds such as tetramethylene-1,4-bis (ethyleneurea), hexamethylene-1,6-bis(ethyleneurea), and the like, esters of methane-sulfonic acid such as trimethylenebis methanesulfonic acid ester, and the like, active vinyl compounds such as bisacroyl urea, metaxylenedivinylsulfonic acid, and the like, and glycidyl-containing compounds such as bisphenolglycidyl ether, and the like, and isocyanates.

It is also preferable to use coalescing aides, more preferably phenolic or naphtholic type compounds (in which one or more hydroxy groups are substituted onto an aromatic ring), for example, phenol, resorcinol, orcinol, catechol, pyrogallol, 2-4-dinitrophenol, 2,4,6-dinitrophenol, 4-chlororesorcinol, 2-4-dihydroxy toluene, 1,3-naphthalenediol, the sodium salt of 1-naphthol-4-sulfonic acid, o-fluorophenol, m-fluorophenol, p-fluorophenol, o-cresol, p-hypdoxybenzotrifluoride, gallic acid, 1-naphthol, chlorophenol, hexyl resorcinol, chloromethylphenol, o-hydroxybenzotrifluoride, m-hydroxybenzotrifluoride, and the like, and mixtures thereof. Chloromethylphenol is especially preferred for use with glycidyl-functional homopolymers. Other coalescing agents include acrylic acid, benzyl alcohol, trichloroacetic acid, chloral hydrate, ethylene carbonate, and combinations of the foregoing. Typically, the concentration of the coalescing aide is about 5–30 %, by weight of solids, preferably 10–20%, in the subbing layer.

The particle size of the glycidyl-containing polymer, in an aqueous polymer dispersion, can be controlled by the conditions of the emulsion polymerization in a conventional manner, for example, by controlling the amount of the surface active agent as the dispersing agent, the stirring condition, the reaction time and the reaction temperature. The particle size is preferably within a range of from 0.05 to 1 micron.

An adhesion-promoting aqueous polymeric composition according to the present invention is usually coated and dried on a polyester support at a coverage of approximately 30 to 300 mg of polymer solids per $m^2$ of support, and in this case a conventional sub-layer coating technique is applicable, for example, dip coating, roll coating, spray coating or the like, wherein the coating process may occur in-line to a continuous web, during manufacture of a thermophotographic or thermographic film support. The coating process may occur anytime during the manufacture of a photographic support such as before biaxial stretching of the support, after machine direction stretching but before transverse stretching or after biaxially stretching. After coating and stretching, the support may be heat relaxed at temperatures over 120° C., generally 100 to 150° C. for several minutes. The amount of the aqueous polymer dispersion of the invention applied as the subbing layer preferably ranges from 30 mg/$m^2$ to 300 mg/$m^2$ based on the weight of the polymer. When the amount is less than the above, the adhesion promoting effect is small. When the amount is more than the above, the adhesion of a subbing layer to an emulsion layer or back layer tends to deteriorate. When the subbing layer or layers have been dried, a photothermographic or thermographic silver-halide layer or emulsion is coated thereon and dried.

Polyester supports used for preparing the subbed polyester support according to the present invention are film-like supports prepared by subjecting a polyester compound to extrusion molding to prepare a film and crystallizing the resulting film by biaxial stretching and thermal setting. Supports which can be used in this invention include any supports of hydrophobic, high molecular weight polyesters. Suitable supports typically have a glass transition temperature (Tg) greater than 90° C. The support may be produced from any suitable synthetic linear polyester which may be obtained by condensing one or more dicarboxylic acids or their lower alkyl esters, e.g. terephthalic acid, isophthalic acid, phthalic acid, 2,5-, 2,6-, and 2,7-naphthalene dicarboxylic acid, succinic acid, sebacic acid, adipic acid, azelaic acid, diphenyl dicarboxylic acid, and hexahydroterephthalic acid or bis-p-carboxyl phenoxy ethane, optionally with a monocarboxylic acid, such as povalic acid, with one or more glycols, e.g., ethylene glycol, 1,3-propanediol, 1,4-butanediol, neopentyl glycol and 1,4-cyclohexanedimethanol. Suitable supports include, for example, polyesters such as polyethylene terephthalate, polyhexamethylene terephthalate, polyethylene-2,6-naphthalate, polyethylene-2,5-naphthalate, and polyethylene-2,7-naphthalate. Within the contemplation of the invention are supports based on copolymers and/or mixtures of polyesters based on different monomers, with polyethylene terephthalate (PET) preferred Suitable supports are described in Research Disclosure, September 1994, Item 36544 available from Kenneth Mason Publications Ltd, Dudley House, 12 North Street, Emsworth Hampshire PO10 7DQ, England (hereinafter "Research Disclosure") and in Hatsumei Kyoukai Koukai Gihou No. 94-6023, Japan Invention Association, Mar. 15, 1994, available from the Japanese Patent Office. Supports with magnetic layers are described in Research Disclosure, November 1992, Item 34390. The film support of the present invention can contain other components commonly found in film supports for photographic elements. These include dyes, lubricants, and particles of organic and inorganic materials such as glass beads. These are described in more detail in Research Disclosure, February 1995, Item 37038, pages 79–114. The supports and associated layers may contain any known additive materials. They may be transparent or can contain a dye or a pigment such as titanium dioxide or carbon black.

In addition to the support, the imaging layer, and the adhesive interlayer, the thermally processable imaging element of this invention can optionally include additional layers such as a backing layers. Particularly useful backing layers are those comprising poly(silicic acid) and a water-soluble hydroxyl-containing monomer or polymer that is compatible therewith, as described in U.S. Pat. No. 4,828,971, issued May 9, 1989. An improved thermally processable imaging element of this invention can contain three different layers each of which is comprised of poly(silicic acid), namely, (1) an overcoat layer whose purpose is to protect the element as described in U.S. Pat. No. 4,741,992, (2) a backing layer whose purpose is to improve conveyance, reduce static electricity and eliminate formation of Newton Rings as described in U.S. Pat. No. 4,828,971, and (3) a barrier layer whose purpose is to protect the support against migration from the imaging layer of hydrolysis by-products and thereby prevent width-wise curl as described in U.S. Pat. No. 5,264,334. The thermally processable imaging elements of this invention also include an electroconductive layer to provide antistatic protection as described in U.S. Pat. No. 5,310,640.

A typical photothermographic element comprises a photosensitive component that consists essentially of photographic silver halide. In the photothermographic material it is believed that the latent image silver from the silver halide acts as a catalyst for the described image-forming combination upon processing. A preferred concentration of photographic silver halide is within the range of 0.01 to 10 moles of photographic silver halide per mole of silver salt such as behenate in the photothermographic material. Other photosensitive silver salts are useful in combination with the photographic silver halide if desired. Preferred photographic silver halides are silver chloride, silver bromide, silver bromochloride, silver bromoiodide, silver chlorobromoiodide, and mixtures of these silver halides. Very fine grain photographic silver halide is especially useful. The photographic silver halide can be prepared by any of the known procedures in the photographic art. Such procedures for forming photographic silver halides and forms of photographic silver halides are described in, for example, Research Disclosure, December 1978, Item No. 17029 and Research Disclosure, June 1978, Item No. 17643. Tabular grain photosensitive silver halide is also useful, as described in, for example, U.S. Pat. No. 4,435,499. The photographic silver halide can be unwashed or washed, chemically sensitized, protected against the formation of fog, and stabilized against the loss of sensitivity during keeping as described in the above Research Disclosure publications. The silver halides can be prepared in situ as described in, for example, U.S. Pat. No. 4,457,075, or prepared ex situ by methods known in the photographic art.

The photothermographic element typically comprises an oxidation-reduction image forming combination that contains an organic silver salt oxidizing agent, preferably a silver salt of a long chain fatty acid. Such organic silver salts are resistant to darkening upon illumination. Preferred organic silver salt oxidizing agents are silver salts of long chain fatty acids containing 10 to 30 carbon atoms. Examples of useful organic silver salt oxidizing agents are silver behenate, silver stearate, silver oleate, silver laurate, silver hydroxystearate, silver caprate, silver myristate, and silver palmitate. Combinations of organic silver salt oxidizing agents are also useful. Examples of useful organic silver salt oxidizing agents that are not organic silver salts of fatty acids are silver benzoate and silver benzotriazole.

The optimum concentration of organic silver salt oxidizing agent in the photothermographic element will vary depending upon the desired image, particular organic silver salt oxidizing agent, particular reducing agent and particular photothermographic element. A preferred concentration of organic silver salt oxidizing agent is within the range of 0.1 to 100 moles of organic silver salt oxidizing agent per mole of silver in the element. When combinations of organic silver salt oxidizing agents are present, the total concentration of organic silver salt oxidizing agents is preferably within the described concentration range.

A variety of reducing agents are useful in the photothermographic element. Examples of useful reducing agents in the image-forming combination include substituted phenols and naphthols, such as bis-beta-naphthols; polyhydroxybenzenes, such as hydroquinones, pyrogallols and catechols; aminophenols, such as 2,4-diaminophenols and methylaminophenols; ascorbic acid reducing agents, such as ascorbic acid, ascorbic acid ketals and other ascorbic acid derivatives; hydroxylamine reducing agents; 3-pyrazolidone reducing agents, such as 1-phenyl-3-pyrazolidone and 4-methyl-4-hydroxymethyl-1-phenyl-3-pyrazolidone; and sulfonamidophenols and other organic reducing agents known to be useful in photothermographic elements, such as described in U.S. Pat. No. 3,933,508, U.S. Pat. No. 3,801,321 and Research Disclosure, June 1978, Item No. 17029. Combinations of organic reducing agents are also useful in the photothermographic element.

Preferred organic reducing agents in the photothernographic element are sulfonamidophenol reducing agents, such as described in U.S. Pat. No. 3,801,381. Examples of useful sulfonamidophenol reducing agents are 2,6-dichloro-4-benzenesulfonamidophenol; benzenesulfonamidophenol; and 2,6-dibromo-4-benzenesulfonamidophenol, and combinations thereof.

An optimum concentration of organic reducing agent in the photothermographic element varies depending upon such factors as the particular photothermographic element, desired image, processing conditions, the particular organic silver salt oxidizing agent, and the particular polyalkoxysilane.

The photothernographic element preferably comprises a toning agent, also known as an activator-toner or toner-accelerator. Combinations of toning agents are also useful in the photothermographic element. Examples of useful toning agents and toning agent combinations are described in, for example, Research Disclosure, June 1978, Item No. 17029 and U.S. Pat. No. 4,123,282. Examples of useful toning agents include, for example, phthalimide, N-hydroxyphthalimide, N-potassium-phthalimide, succinimide, N-hydroxy-1,8-naphthalimide, phthalazine, 1-(2H)-phthalazinone and 2-acetylphthalazinone.

Post-processing image stabilizers and latent-image keeping stabilizers are useful in the photothermographic element. Any of the stabilizers known in the photothermographic art are useful for the described photothermographic element. Illustrative examples of useful stabilizers include photolytically active stabilizers and stabilizer precursors as described in, for example, U S. Pat. No. 4,459,350. Other examples of useful stabilizers include azole thioethers and blocked azolinethione stabilizer precursors and carbamoyl stabilizer precursors, such as described in U.S. Pat. No. 3,877,940.

The thermally processable elements as described preferably contain, as a vehicle or binder for image-forming layers or emulsions, a poly(vinyl acetal) alone or in combination with other vehicles or binders in various layers. Common poly(vinyl acetals) are poly(vinyl formal) and poly(vinyl butyral). Poly(vinyl butyral) is preferred. Other optional synthetic polymeric compounds that are useful include dispersed vinyl compounds, such as in latex form, and particularly those that increase dimensional stability of photographic elements. Effective polymers include water insoluble polymers of acrylates, such as alkylacrylates and methacrylates, acrylic acid, sulfoacrylates, and those that have cross-linking sites. Preferred high molecular weight materials and resins include cellulose acetate butyrate, poly (methylmethacrylate), poly(vinylpyrrolidone), ethyl cellulose, polystyrene, poly(vinylchloride), chlorinated rubbers, polyisobutylene, butadiene-styrene copolymers, copolymers of vinyl chloride and vinyl acetate, copolymers of vinylidene chloride and vinyl acetate, poly(vinyl alcohol) and polycarbonates.

Photothermographic elements and thermographic elements as described can contain addenda that are known to aid in formation of a useful image. The photothermographic element can contain development modifiers that function as speed increasing compounds, sensitizing dyes, hardeners, antistatic agents, plasticizers and lubricants, coating aids, brighteners, absorbing and filter dyes, such as described in Research Disclosure, December 1978, Item No. 17643 and Research Disclosure, June 1978, Item No. 17029.

The layers of the thermally processable element are coated on a support by coating procedures known in the photographic art, including dip coating, air knife coating, curtain coating or extrusion coating using hoppers. If desired, two or more layers are coated simultaneously.

Spectral sensitizing dyes are useful in the photothermographic element to confer added sensitivity to the element. Useful sensitizing dyes are described in, for example, Research Disclosure, June 1978, Item No. 17029 and Research Disclosure, December 1978, Item No. 17643.

A photothermographic element as described preferably comprises a thermal stabilizer to help stabilize the photothermographic element prior to exposure and processing. Such a thermal stabilizer provides improved stability of the photothermographic element during storage. Preferred thermal stabilizers are 2-bromo-2-arylsulfonylacetamides, such as 2-bromo-2-p-tolysulfonylacetamide; 2-(tribromomethyl sulfonyl)benzothiazole; and 6-substituted-2,4-bis (tribromomethyl)-s-triazines, such as 6-methyl or 6-methyl or 6-phenyl-2,4-bis(tribromomethyl)-s-triazine.

The thermally processable elements are exposed by means of various forms of energy. In the case of the photothermographic element, such forms of energy include those to which the photographic silver halides are sensitive and include ultraviolet, visible and infrared regions of the electromagnetic spectrum as well as electron beam and beta radiation, gamma ray, x-ray, alpha particle, neutron radiation and other forms of corpuscular wave-like radiant energy in either non-coherent (random phase) or coherent (in phase)

forms produced by lasers. Exposures are monochromatic, orthochromatic, or panchromatic depending upon the spectral sensitization of the photographic silver halide. Imagewise exposure is preferably for a time and intensity sufficient to produce a developable latent image in the photothermographic element.

After imagewise exposure of the photothermographic element, the resulting latent image is developed merely by overall heating the element to thermal processing temperature. This overall heating merely involves heating the photothermographic element to a temperature within the range of about 90° C. to 180° C. until a developed image is formed, such as within about 0.5 to about 60 seconds. By increasing or decreasing the thermal processing temperature a shorter or longer time of processing is useful. A preferred thermal processing temperature is within the range of about 100° C. to about 130° C.

In the case of a thermographic element, the thermal energy source and means for imaging can be any imagewise thermal exposure source and means that are known in the thermographic imaging art. The thermographic imaging means can be, for example, an infrared heating means, laser, microwave heating means or the like.

Heating means known in the photothermographic and thermographic imaging arts are useful for providing the desired processing temperature for the exposed photothermographic element. The heating means is, for example, a simple hot plate, iron, roller, heated drum, microwave heating means, heated air or the like.

Thermal processing is preferably carried out under ambient conditions of pressure and humidity. Conditions outside of normal atmospheric pressure and humidity are useful.

The components of the thermally processable element can be in any location in the element that provides the desired image. If desired, one or more of the components can be in more than one layer of the element. For example, in some cases, it is desirable to include certain percentages of the reducing agent, toner, stabilizer and/or other addenda in an overcoat layer over the photothermographic imaging layer of the element. This, in some cases, reduces migration of certain addenda in the layers of the element.

It is necessary that the components of the imaging combination be "in association" with each other in order to produce the desired image. The term "in association" herein means that in the photothermographic element the photographic silver halide and the image forming combination are in a location with respect to each other that enables the desired processing and forms a useful image.

The thermally processable imaging element of this invention preferably includes a backing layer. The backing layer utilized in this invention is an outermost layer and is located on the side of the support opposite to the imaging layer. It is typically comprised of a binder and a matting agent that is dispersed in the binder in an amount sufficient to provide the desired surface roughness.

A wide variety of materials can be used to prepare a backing layer that is compatible with the requirements of thermally processable imaging elements. The backing layer should be transparent and colorless and should not adversely affect sensitometric characteristics of the photothermographic element such as minimum density, maximum density and photographic speed. Preferred backing layers include those formed from polymethylmethacrylate, cellulose esters, and those comprised of poly(silicic acid) and a water-soluble hydroxyl containing monomer or polymer that is compatible with poly(silicic acid) as described in U.S. Pat. No. 4,828,971. A combination of poly(silicic acid) and poly(vinyl alcohol) is particularly useful. Other useful backing layers include those formed from cellulose acetate, crosslinked polyvinyl alcohol, terpolymers of acrylonitrile, vinylidene chloride, and 2-(methacryloyloxy) ethyltrimethylammonium methosulfate, crosslinked gelatin, polyesters and polyurethanes.

In the thermally processable imaging elements of this invention, either organic or inorganic matting agents can be used. Examples of organic matting agents are particles, often in the form of beads, of polymers such as polymeric esters of acrylic and methacrylic acid, e.g., poly (methylmethacrylate), styrene polymers and copolymers, and the like. Examples of inorganic matting agents are particles of glass, silicon dioxide, titanium dioxide, magnesium oxide, aluminum oxide, barium sulfate, calcium carbonate, and the like. Matting agents and the way they are used are further described in U.S. Pat. Nos. 3,411,907 and 3,754,924.

In order to improve image tone, improve printout, provide better visual contrast and enhance the appearance of the thermally processable imaging elements of this invention, a small amount of a colorant can be added to the overcoat layer. Blue colorants, such as Victoria Pure Blue BO, Victoria Brilliant Blue G, Serva Blue WS, Aniline Blue, Page Blue G-90 and Methylene Blue, are especially useful for this purpose.

In a preferred embodiment of this invention, the thermally processable imaging element also includes an electroconductive layer to serve as an antistatic layer. For this purpose, the electroconductive layer should have an internal resistivity of less than $5\times10^{10}$ ohms/square. Electroconductive layers are described in the aforementioned U.S. Pat. No. 5,310,640 to L. Jeffrey Markin, Diane E. Kestner, Wojciech M. Przezdziecki and Peter J. Cowdery-Corvan.

The electroconductive layer utilized in this invention in accordance with the teachings of the aforesaid patent is an "inner layer", i.e., a layer located under one or more overlying layers. It can be disposed on either side of the support. As indicated hereinabove, it has an internal resistivity of less than $5\times10^{10}$ ohms/square. Preferably, the internal resistivity of the electroconductive layer is less than $1\times10^{10}$ ohms/square.

A colloidal gel of vanadium pentoxide is especially useful for forming the electroconductive layer. When vanadium pentoxide is used for this purpose, it is desirable to interpose a barrier layer between the electroconductive layer and the imaging layer so as to inhibit migration of vanadium pentoxide from the electroconductive layer into the imaging layer with resulting adverse sensitometric affects. Suitable barrier layers include those having the same composition as the backing layer of U.S. Pat. No. 4,828,971, namely, a mixture of poly(silicic acid) and a water-soluble hydroxyl-containing monomer or polymer.

The thermally processable imaging element of this invention preferably includes an overcoat on the imaging layer. Preferred overcoats are those comprised of poly(silicic acid) and a water-soluble hydroxyl containing monomer or polymer that is compatible with the poly(silicic acid) as described in U.S. Pat. No. 4,741,992. An overcoat comprised of poly(vinyl alcohol) and colloidal silica or colloidal alumina is particularly useful. Other preferred overcoats are described in Research Disclosure, June 1978, Item No. 17029.

The thermophotographic or thermographic elements can be single color elements or multicolor elements. Multicolor elements contain image dye-forming units sensitive to each of the three primary regions of the spectrum. Each unit can comprise a single imaging layer or multiple imaging layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor thermophotographic or thermographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

The entire contents of the various patents and other publications cited in this specification are incorporated herein by reference.

The present invention is concretely illustrated below with reference to examples, but it should be construed that embodiments of the invention are not limited only to those examples and they are not to be considered as limiting the scope of the invention. All parts are to be taken as parts by weight.

EXAMPLE 1

This example illustrates the adhesion of a poly(vinyl butyral), Butvar® B76 from Solutia Inc., to a subbed support. Polymers used in this example were prepared by standard latex polymerization techniques. The types of polymers tested are listed in Table 1 below, also indicating the weight ratio of monomers in copolymers.

Preparation of Latex Polymers

Poly(glycidyl methacrylate) was synthesized as follows. To a 20-gallon, glass-lined reactor added 19.14 kg of demineralized water. To a 20-gallon glass-lined head tank was added 18 kg of demineralized water. The agitators on both vessels were set at 60 RPM. A nitrogen atmosphere was established in the system. Next was added 932.4 g of Rhodacal® A246L which was rinsed into the reactor with 1 kg of demineralized water. The reactor contents temperature was set at 60° C. Then was added 18.75 kg of glycidyl methacrylate and 932.4 g of Rhodacal® A246L, rinsed in with 1 kg of demineralized water to the head tank. When the monomer emulsion was prepared in the head tank and when the reactor contents temperature was at 60° C., then 186.5 g of azobis(4-cyano)valeric acid (75%) was added to the reactor. Within two minutes, pumping of the monomer emulsion into the reactor at 310–320 mL/minute was begun. The length of the monomer pump was 120 minutes+/−10 minutes. When the monomer addition was complete, the head tank was rinsed with 2 kg of demineralized water which was pumped through the lines and into the reactor. The reactor contents were stirred for two hours at 60° C. A 12-liter dropping funnel was charged with 3980 mL of demineralized water and 341.6 g of (35%) hydrogen peroxide. The pump was set for 37–40 mL/min. Then added to the reactor was 32 g of erythorbic acid dissolved in 1 kg of demineralized water. Within two minutes began the addition from the 12 liter dropping funnel. The charge took 30 minutes. When the addition was complete, the flask was rinsed with 1 kg of demineralized water, which was pumped through the lines and into the reactor. The reactor contents were stirred for an additional hour at 60° C. The latex was then cooled to 25° C. and filtered through a 30 micron cartridge filter into clean, 5-gallon "Win-Pak" pails. The total yield of latex was 68 kg at 30% solids. Copolymers of glycidyl methacrylate with butyl acrylate and ethyl acrylate were also synthesized.

Subbed supports were prepared by first coating a solution of the subbing onto as-cast PET. The solution contained 7% of the polymer latex, 1% resorcinol or chlormethylpheonol (as indicated in Table 1 below), 0.2% saponin in water. After drying, the PET with the adhesion promoting polymer coating was stretched and tentered at elevated temperature, resulting in an adhesion layer that is approximately 100 nm thick. On top of this subbed support, a solution of 8.5% Butvar® B76(polyvinyl butyral from Solutia) in MEK was coated using a 20 mil knife on a 30° C. heated block. The sample was then dried for 2 hrs at 100° C. For comparision a support was also prepared using a vinylidene chloride containing latex polymer, example C2 in Table 1. As a control, a bare base with no subbing layer was used.

To measure the adhesion of the Butvar® B76 to the subbed support, a T-peel adhesion test was performed using 1-inch wide strips at about 2 inches/min. A strip of 610 tape ( from 3M, Inc.) was placed on the Butvar® layer to provide some reinforcement and help initiate peel. Upon peeling, the force to remove the Butvar® layer was recorded in force/width (N/m), with larger numbers indicating better adhesion (>300 N/m indicates that the force to remove the layer was greater that the adhesive strength of the tape to the Butvar® layer). The results are shown in Table 1 below.

TABLE 1

| Example | Coalescesing Aide Used With Subbing Polymer | Subbing Polymer* | T-Peel Force (N/m) |
|---|---|---|---|
| C1 | None | None - control | 2.4 |
| C2 | Resorcinol | Poly(methylacrylate-co-vinylidene Chloride-co-itaconic acid) 15/83/2 | >300 |
| 3 | Chloromethylphenol | Poly(glycidyl methacrylate) | >300 |
| C4 | Resorcinol | Poly(glycidyl methacrylate-co-butylacrylate) 73/27 | 100 |
| 5 | Resorcinol | Poly(glycidyl methacrylate-co-butylacrylate) 84/16 | 130 |
| C6 | Resorcinol | Poly(glycidyl methacrylate-co-ethylacrylate) 68/32 | 100 |
| 7 | Resorcinol | Poly(glycidyl methacrylate-co-ethylacrylate) 80/20 | 196 |

*Polymer compositions given in mole ratios

These results show that the binder for the photothermographic emulsions, in this case Butvar® poly(vinyl butyral), exhibited good adhesion to the glycidyl-methacrylate-containing polymers and that the adhesion increases with increasing glycidyl-methacrylate content in the polymer (particularly, when greater than 75 mole percent of glycidyl-functional monomeric units), with the homopolymer of poly(glycidyl methacrylate) providing excellent adhesion.

EXAMPLE 2

This example illustrates the adhesion of a photothermographic emulsion according to the present invention. The subbed supports were prepared in the same manner as described in Example 1. The type of polymer subs used in this example are listed in Table 4 below, with the rate ratio of monomers in the copolymers indicated for the copolymer. To this support, a thermally processable imaging element was applied, which comprises a photothermographic imaging layer and a protective overcoat. The layers of the thermally processable imaging element are coated on the support using an X-hopper. The photothermographic imaging composition was coated from a solvent mixture containing 73.5% 2-butanone, 11.0% toluene, 15% methanol, and 0.5% Dowanol® (2-phenoxyethanol) at a wet coverage of 86 cc/m$^2$ to form an imaging layer of the following dry composition:

TABLE 2

| Components | Dry Coverage (g/m$^2$) |
|---|---|
| Succinimide | 0.072 |
| Phthalimide | 0.286 |
| Poly-dimethyl siloxane (General Electric SF-96-200) | 0.003 |
| 2-Bromo-2-((4-methylphenyl)sulfonyl)acetamide | 0.052 |
| Naphthyl triazine | 0.013 |
| Palmitic acid | 0.063 |
| N-(4-hydroxyphenyl)-benzenesulfonamide | 0.858 |
| Silver, as silver bromide | 0.230 |
| B-15708 sensitizing dye | 0.002 |
| Silver, as silver behenate | 4.686 |
| Polyvinyl butyral, M.W. 90,000–120,000 (Monsanto Butvar ® B-76, 11–13% hydroxyl content) | 3.575 |
| Mercury, as mercuric bromide | 0.001 |
| Chlorowax ® 65, a chlorinate paraffin from OxyChem | 0.358 |
| Sodium Iodide | 0.0002 |

The resulting imaging layer was then overcoated with mixture of polyvinyl alcohol and hydrolyzed tetraethyl orthosilicate as described in Table 3 below at a wet coverage of 40.4 g/m$^2$ and dried.

TABLE 3

| Component | Grams |
|---|---|
| Distilled Water | 226.4 |
| Polyvinyl Alcohol (PVA, Elvanol ® 52-22 from DuPont, 86–89% hydrolyzed) (6.2% by weight in distilled water) | 443.0 |
| Tetraethyl Orthosilicate (35.4% by weight in methanol/water (53:47)) | 251.6 |
| p-Toluene Sulfonic Acid (1N solution in distilled water) | 3.1 |
| Olin ® 10G (10% by weight in distilled water. (Olin 10G is para-isononylphenoxy polyglycidol available from the Olin Corp., U.S.A.) | 10.0 |
| Silica (1.5 micron) | 3.0 |

Evaluations

Blocking—before coating the support with emulsion, the tendency for the front side to stick or block to the back side was evaluated (none, slight or severe).

Dmax—after incubating the samples for 1 week at 120 F./50% RH, 35 mm strips of the samples were exposed with a laser using a 21-step tablet and thermally processed at 117° C. for 10 sec. The Dmax density was recorded.

Delamination—as a measure of the adhesion of the emulsion to the base, the amount of emulsion delamination was determined by examining the edges of the film after slitting. The amount of delamination was ranked as severe, slight or none.

The results of these evaluations are shown in Table 4 below.

TABLE 4

| Subbing material | Blocking | Dmax | Delamination |
|---|---|---|---|
| None | None | 3.18 | Severe |
| Poly(methylacrylate-co-vinylidene chloride-co-itaconic acid) 15/83/2 | Slight | 2.79 | Slight* |
| Poly(glycidyl methacrylate) | None | 3.44 | Slight* |

*significant cohesive failure in the emulsion observed

The data in Table 4 shows that the poly(glycidyl methacrylate)-subbed support provides comparatively improved adhesion with no impact on image density or blocking of the support.

The present invention provides an important improvement in thermally processable imaging elements. The adhesive interlayer of this invention overcomes the problem of inadequate adhesion and does so without causing adverse sensitometric effects or blocking to the backside during manufacturing.

What is claimed is:

1. A thermally processable imaging element, said element comprising:

(a) a polyester support;

(b) a thermographic or photothermographic imaging layer comprising a poly(vinyl acetal) binder;

(c) an adhesive interlayer bonding said support to said imaging layer; said adhesive interlayer comprising a polymer having glycidyl functionality, wherein the mole percent of recurring units having glycidyl functionality is greater than 75 mole percent.

2. A thermally processable imaging element as claimed in claim 1 wherein said imaging layer comprises:

(a) photographic silver halide, and (b) an image-forming combination comprising (i) an organic silver salt oxidizing agent, with (ii) a reducing agent for the organic silver salt oxidizing agent.

3. A thermally processable imaging element as claimed in claim 1 wherein said polymer is comprised of recurring units of which greater than 90 mole percent contain a glycidyl functionality.

4. A thermally processable imaging element as claimed in claim 1, further comprising a phenolic coalescing agent.

5. A thermally processable imaging element according to claim 4 wherein the coalescing agent is chloromethylphenol.

6. A thermally processable imaging element as claimed in claim 1 wherein said poly(vinyl acetal) is poly(vinyl butyral).

7. A thermally processable imaging element as claimed in claim 1 wherein said imaging layer comprises:

(a) photographic silver halide, (b) an image-forming combination comprising (i) silver behenate, with (ii) a phenolic reducing agent for the silver behenate.

8. A thermally processable imaging element as claimed in claim 1, further comprising a backing layer comprised of a binder and a matting agent dispersed therein.

9. A thermally processable imaging element as claimed in claim 8 wherein said backing layer is comprised of poly (silicic acid) and a water-soluble hydroxyl-containing monomer or polymer.

10. A thermally processable imaging element as claimed in claim 1 wherein said adhesive interlayer has a thickness in the range of from about 0.008 to about 0.05 microns.

11. A thermally processable imaging element as claimed in claim 1, said polyester support comprising poly(ethylene terephthalate).

12. A thermally processable element as claimed in claim 1 wherein the polyester support comprises a polyethylene naphthalate film.

13. A thermally processable element as claimed in claim 1 wherein said polymer comprises greater than 75 mole percent of glycidyl acrylate and/or glycidyl methacrylate monomer and 0 to 25 mole percent of at least one copolymerizable vinyl comonomer.

14. A thermally processable element as claimed in claim 13 wherein said copolymerizable vinyl comonomer is a member selected from the group consisting of acrylic acid; methacrylic acid; alkyl acrylate, said alkyl group having from one to four carbon atoms; alkyl methacrylate, said alkyl group having from one to four carbon atoms; acrylamide; methacrylamide; vinyl chloride vinylidene chloride; N-vinylamide; styrene; alpha-methyl styrene; acrylonitrile; and methacrylonitrile.

15. A thermally processable element as claimed in claim 1 wherein said polymer is a member selected from the group consisting of glycidyl methacrylate-butyl methacrylate copolymer, glycidyl acrylate-ethyl acrylate copolymer, and glycidyl methacrylate-acrylic acid copolymer.

16. A method for making a thermally processable imaging element, said element comprising a polyester support and a thermographic or photothermographic imaging layer comprising a poly(vinyl acetal) binder, which method comprises applying an adhesive interlayer bonding said support to said imaging layer; said adhesive interlayer comprising a polymer having glycidyl functionality and wherein the polymer comprising more than 75 mole percent of glycidyl-functional recurring units.

17. A method according to claim 16 wherein the polymer comprises more than 75 mole percent glycidyl acrylate and/or glycidyl methacrylate monomer.

18. A method according to claim 16 wherein the polymer is coating onto the support in the form of an aqueous dispersion.

19. A method according to claim 16, further comprising a phenolic coalescing agent.

20. A method according to claim 16 wherein the coalescing agent is chloromethylphenol.

21. A method according to claim 16 wherein the aqueous dispersion further comprises a surface active agent.

22. A method according to claim 16 wherein the polyester support comprises polyethylene terephthalate.

23. A method according to claim 16 wherein the polyester support is a biaxially stretched polyethylene terephthalate.

24. A method according to claim 16, wherein said aqueous dispersion comprises polymer in the form of particles have an average particle size ranging from 0.05 to 1 micron.

25. A method according to claim 16 wherein the laydown of the polymer in the interlayer is 30 to 300 $mg/m^2$.

* * * * *